US010441861B1

(12) United States Patent
Mattern et al.

(10) Patent No.: US 10,441,861 B1
(45) Date of Patent: Oct. 15, 2019

(54) HITTABLE PROTECTIVE BAT COVERS

(71) Applicants: Erik Mattern, Newport Beach, CA (US); Steven C Schinko, Costa Mesa, CA (US)

(72) Inventors: Erik Mattern, Newport Beach, CA (US); Steven C Schinko, Costa Mesa, CA (US)

( * ) Notice: Subject to any disclaimer, the term of this patent is extended or adjusted under 35 U.S.C. 154(b) by 0 days.

(21) Appl. No.: 15/904,145

(22) Filed: Feb. 23, 2018

Related U.S. Application Data

(60) Provisional application No. 62/516,003, filed on Jun. 6, 2017.

(51) Int. Cl.

| | |
|---|---|
| ***A63B 69/00*** | (2006.01) |
| ***A63B 60/60*** | (2015.01) |
| ***A63B 59/50*** | (2015.01) |
| ***A63B 60/46*** | (2015.01) |
| *A63B 102/18* | (2015.01) |

(52) U.S. Cl.
CPC ..... *A63B 60/60* (2015.10); *A63B 59/50* (2015.10); *A63B 60/46* (2015.10); *A63B 69/0002* (2013.01); *A63B 2069/0008* (2013.01); *A63B 2102/18* (2015.10); *A63B 2102/182* (2015.10); *A63B 2209/10* (2013.01); *A63B 2220/16* (2013.01); *A63B 2220/53* (2013.01); *A63B 2220/58* (2013.01); *A63B 2220/833* (2013.01)

(58) Field of Classification Search
CPC ..... A63B 69/0002; A63B 2069/0008
USPC ..... 473/437, 457
See application file for complete search history.

(56) References Cited

U.S. PATENT DOCUMENTS

| | | | | | |
|---|---|---|---|---|---|
| 2,676,803 | A * | 4/1954 | Damaske | A63B 69/3638 | 150/160 |
| 2,737,394 | A * | 3/1956 | Abel | A63B 60/62 | 150/160 |
| 3,623,724 | A * | 11/1971 | Lande | A63B 60/00 | 473/437 |
| 4,671,510 | A * | 6/1987 | Schoenwetter | A63B 69/38 | 473/437 |
| 5,213,324 | A * | 5/1993 | Bowers | A63B 69/0002 | 273/DIG. 30 |
| 5,605,325 | A * | 2/1997 | Haringa | A63B 69/0002 | 473/457 |
| 5,980,397 | A * | 11/1999 | Hart | A63B 59/50 | 473/437 |
| 6,533,685 | B1 * | 3/2003 | Otten | A63B 59/60 | 473/437 |

(Continued)

*Primary Examiner* — Mark S Graham

(57) ABSTRACT

Protective covers for preventing damage to ball bats during batting practice are comprised of an impact force absorbing elastic sleeve which has through its length bore and a V-shaped notch extending forward from a rear transverse edge of the sleeve, dividing a rear length of the sleeve into opposed flaps, thus providing an enlarged entrance opening which facilitates insertion of a bat into the sleeve bore. A strap extending radially from one flap is releasably attachable by a closure fastener to the other flap, enabling the flaps to be cinched around and secured to a bat inserted into the sleeve bore. The protective covers may optionally have weights and/or friction strips positioned within the sleeve, and may optionally include an inertial sensor or impact force sensor and radio transmitter for transmitting signals representative of bat motions or impact forces exerted on the bat.

3 Claims, 13 Drawing Sheets

(56) References Cited

U.S. PATENT DOCUMENTS

| | | | | |
|---|---|---|---|---|
| 6,681,821 | B1 * | 1/2004 | Cirone | A63B 60/58 150/154 |
| 6,739,989 | B2 * | 5/2004 | Liberatore | A63B 69/0002 473/457 |
| 7,540,813 | B2 * | 6/2009 | Liberatore | A63B 15/00 473/457 |
| 7,670,238 | B2 * | 3/2010 | Esquerra | A63B 69/0002 473/422 |
| 7,686,711 | B2 * | 3/2010 | Miller | A63B 69/0002 473/422 |
| 8,231,484 | B1 * | 7/2012 | Quinn | A63B 69/0002 473/422 |
| 2009/0069126 | A1 * | 3/2009 | Merchant | A63B 21/0605 473/437 |

* cited by examiner

C
B
A
D
15
11
36
12
26
13
24
31
30
32
27
29
16

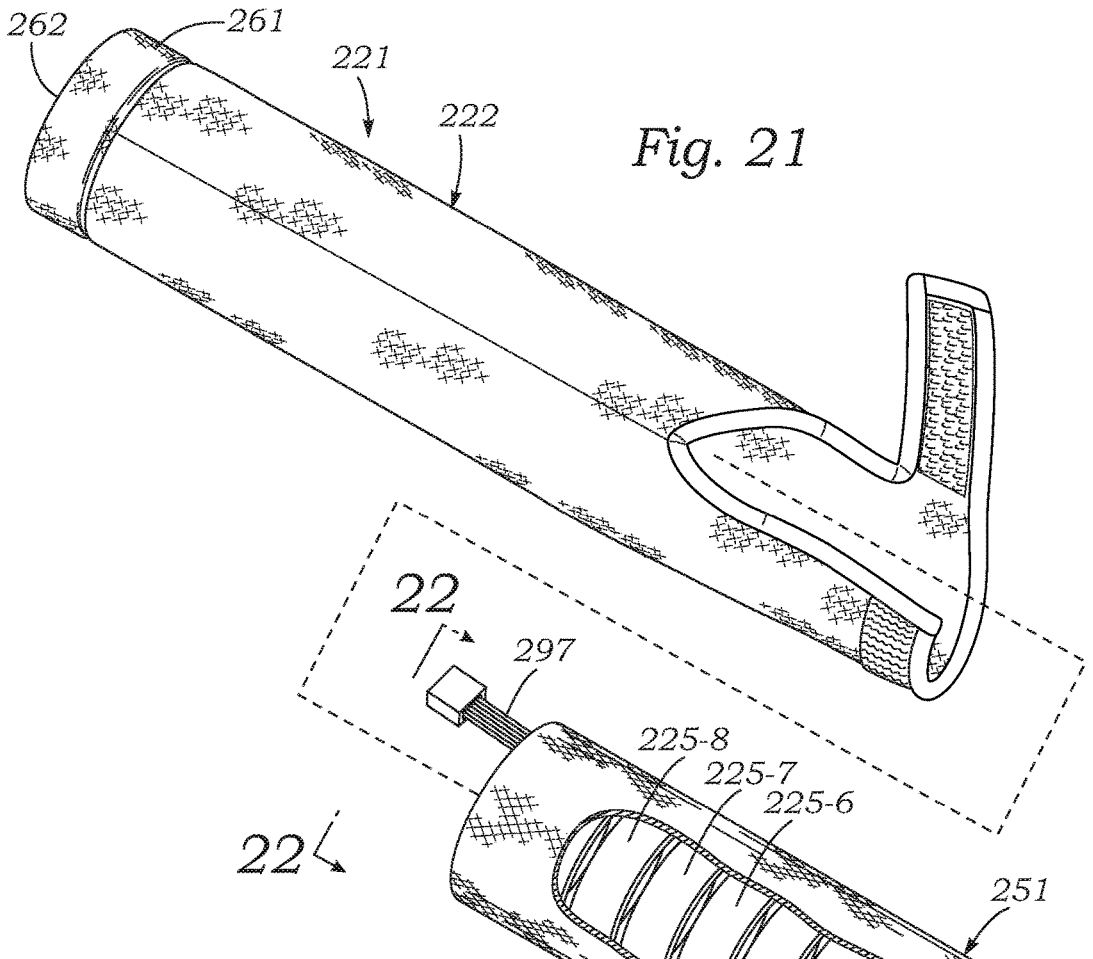
Fig. 21
Fig. 22
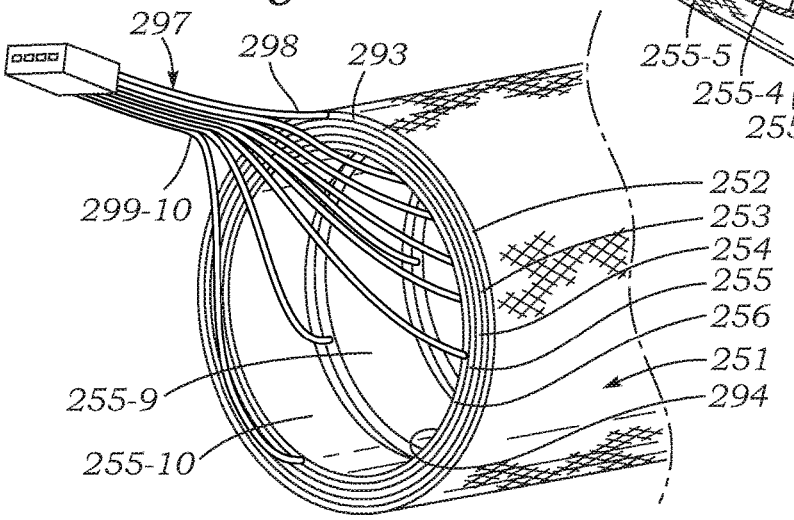

HITTABLE PROTECTIVE BAT COVERS

The present invention claims priority of and to U.S. Provisional Application Nos. 62/516,003, filed Jun. 6, 2017, 62/471,303, filed Mar. 14, 2017, and 62/463,568, filed Feb. 24, 2017.

BACKGROUND OF THE INVENTION

A. Field of the Invention

The present invention relates to sporting equipment and accessories, particularly of a type used in developing and maintaining skills for batting a baseball or softball. More particularly, the invention relates to a protective cover device for attachment to a baseball bat or softball bat, which protects a bat from being damaged by hitting balls during batting practice, has optional weight pockets for receiving weights of various values, optional sensors for measuring parameters such as bat motions and impact properties of a struck ball and a radio transmitter and optional flash memory chip for transmitting and recording measurement data via a radio frequency signal to a receiver.

B. Description of Background Art

Every player on a baseball or softball team, with the pitcher sometimes exempted, is expected to possess batting skills sufficient to get on base or score a home run. Since pitchers can hurl balls towards a batter at speeds exceeding 90 miles per hour, it is not surprising that hitting a pitched ball requires substantial hand-eye coordination. Moreover, it requires substantial physical strength to hit a ball with sufficient force as well as accuracy to be able to drive the ball beyond the easy reach of fielders of the opposing team. Also, since each ball player is up at bat for a relatively small percentage of game time, e.g., 2% to 5%, a ball player is rarely able to develop even moderate efficiency in batting a ball solely by playing in ball games.

For the foregoing reasons, batting practice is an essential part of a successful ballplayer's training regimen. The required batting practice can be performed by swinging at balls pitched by a human pitcher or a pitching machine. In either case, players generally prefer to use a particular bat or bat type to practice, so that muscle training achieved in batting practice will be applicable to performance in ball games.

Since a favored type of bat can be quite expensive, e.g., 150 dollars for a wood bat and g up to 450 dollars for certain metal bats, it would be desirable to provide a protective cover for a bat used in batting practice to minimize the likelihood of causing cosmetic or structural damage to a bat during batting practice.

In recognition of the foregoing facts, various protective covers for ball bats used in batting practice have been disclosed. The following patents typify such prior art protective devices for bats: U.S. Pat. No. 5,605,325, Haringa, Feb. 25, 1997; U.S. Pat. No. 5,695,419, Haringa, Dec. 9, 1997; and U.S. Pat. No. 6,093,114, Haringa, Jul. 25, 2000.

The present invention was developed by the inventor to provide versatile protective bat covers for use both in swing training and live batting sessions.

OBJECTS OF THE INVENTION

An object of the present invention is to provide protective covers for preventing impact damage to bats used to hit a baseball or softball with full impact energy and momentum during batting practice.

Another object of the invention is to provide an impact-damage preventing protective covers for wooden and metal ball bats of various sizes and weights.

Another object of the invention is to provide protective covers for wooden or metal ball bats of various sizes, which enable a ball to be struck with full swing force during batting practice, while protecting the bat from impact damage.

Another object of the invention is to provide impact-damage preventing protective covers for ball bats that minimally affect the impact parameters of a ball struck by a bat to which the protective cover is attached.

Another object of the invention is to provide impact-damage preventing, hittable ball bat protectors which may include one or more optional weights spaced longitudinally apart from each other and away from the striking region of a bat to which the protective cover may be attached.

Another object of the invention is to provide impact-damage preventing, hittable ball bat protectors which may include an optional weight that is located at a forward end of the protector and thus forward of the front end of the barrel of a bat to which the protective cover is attached, thus increasing the moment of inertia about a swing axis perpendicular to the longitudinal axis of the bat.

Another object of the invention is to provide a hittable impact-damage preventing bat covers which have impact energy and shock absorbing properties that dissipate vibrations and sting forces which would be transmitted to the hands of a batter hitting a ball with a bat not fitted with the cover.

Another object of the invention is to provide hittable impact-damage preventing bat covers which are removably attachable to ball bats of various sizes and shapes, have minimal effects upon the impact parameters such as impact forces and acoustic signatures of balls struck during live batting practice, and which may include an optional tip-end weight to increase the moment of inertia of the bat and thus improve batting skills.

Another object of the invention is to provide multi-function impact damage preventing, hittable ball bat protectors which may optionally include a pocket for holding a weight located at a forward end of the protector, and may optionally include a releasably sealable pocket for containing weighted materials located at a rear end of the protector.

Another object of the invention is to provide multi-function impact damage preventing, hittable ball bat protectors which may optionally include an inertial motion sensor for measuring motions of a bat and a radio frequency transmitter for transmitting measurement data to a radio receiver and display and/or recording device.

Another object of the invention is to provide multi-function impact damage preventing, hittable ball bat protectors which optionally include a vibration measurement sensor and a radio frequency transmitter for transmitting signals which are indicative of amplitudes and frequencies of vibrations of a bat to which a protector is attached.

Another object of the invention is to provide multi-function impact damage preventing, hittable ball bat protectors which include an impact force measurement sensor located in an area of the bat which impacts a struck ball, and a radio frequency transmitter for transmitting signals which are indicative of amplitudes and locations of impact forces between the bat and a struck ball.

Another object of the invention is to provide a multi-function hittable impact-damage preventing hittable bat protection covers which optionally have impact energy and shock absorbing properties that dissipate vibrations and sting forces which would be transmitted to the hands of a batter hitting a ball with a bat not fitted with the cover.

Another object of the invention is to provide multi-function hittable impact-damage preventing bat covers which are removably attachable to ball bats of various sizes and shapes, have minimal effects upon the impact parameters such as impact forces and acoustic signatures of balls struck during live batting practice, and which may include optional tip-end and/or rear-end weights to increase the moment of inertia of the bat and thus improve batting skills.

Various other objects and advantages of the present invention, and its most novel features, will become apparent to those skilled in the art by perusing the accompanying specification, drawings and claims.

It is to be understood that although the invention disclosed herein is fully capable of achieving the objects and providing the advantages described, the characteristics of the invention described herein are merely illustrative of the preferred embodiments. Accordingly, we do not intend that the scope of my exclusive rights and privileges in the invention be limited to details of the embodiments described. We do intend that equivalents, adaptations and modifications of the invention reasonably inferable from the description contained herein be included within the scope of the invention as defined by the appended claims.

SUMMARY OF THE INVENTION

Briefly stated, the present invention comprehends multi-function protective covers for bats, particularly baseball bats and softball bats. According to the invention, a protective cover is provided which is quickly and easily attachable to and removable from baseball bats and softball bats of various sizes and shapes. The novel design and construction of the protective cover according to the present invention enables a bat fitted with the cover to hit a baseball or softball with full swing force during a batting practice session while protecting the bat from being dented or structurally damaged by hitting a ball, while also minimally affecting impact parameters of a struck ball, such as impact force and acoustic signature of sounds made by striking a ball.

A basic embodiment of a hittable protective cover for ball bats according to the present invention includes a longitudinally elongated, elastically stretchable tubular sleeve. The sleeve has generally the shape of an elongated circular cross-section tube which has at a front transverse end thereof a circular end cap. The sleeve has extending through its length a circular cross-section bore of an appropriate diameter to slidably receive therein in a relatively snug fit the front barrel end of a bat, which is insertable forward into the sleeve through a rear open end of the sleeve.

Preferably, the protective cover sleeve has a V-shaped notch which extends longitudinally forward from a rear annular edge wall of the sleeve. The notch is provided to substantially enlarge the size of the rear open end of the sleeve and thus enable the larger diameter, barrel end of bats of various diameters to be easily inserted forward into the bore within the interior of the sleeve.

The protective cover sleeve is also provided with a fastener to circumferentially encircle and cinch around the tapered part of a bat located between the handle knuckle at the rear end of the bat, and the enlarged front barrel part of the bat. The fastener is engaged after the barrel end of the bat has been inserted fully into the sleeve bore with the tip end of the bat contacting the inner transverse side of the tip end cap at the front end of the sleeve.

In a preferred embodiment of a hittable protective cover for ball bats according to the present invention, the cinch fastener includes a rectangular strap which extends radially outwards from a first oblique side of the V-shaped notch in the sleeve. The strap has a rear edge which is coextensive with the rear annular edge of the sleeve, and has on a lower surface thereof a rectangular hook-type fabric strip.

The opposite oblique side of the V-shaped notch has extending radially away from the notch opening a rectangularly shaped strip made of a loop-type fabric fastener strip and has a rear edge which is coextensive with the rear annular edge wall of the sleeve. After a bat has been fully inserted into the sleeve, the rectangular fastener strap is looped over the V-shaped notch, and the hook-surface of the protruding rectangular fastener strip is pressed down against the upper surface of the loop-type fastener on the opposite side of the notch. Pressing the hook and loop fastener parts together closes the rear end of the sleeve around its rear opening, to thus cinch the lower end of the sleeve into compressive contact with the outer circumferential surface of a bat.

According to one aspect of the present invention, the protective cover has a novel construction which minimizes the possibility of cosmetic or structural damage occurring to a bat from repeated impacts of struck balls, while minimizing impact parameters of a bat. Impact parameters as defined here include energy and momentum imparted to a ball hit by a bat, and also the acoustic signature or cracking sound produced by the impact of a ball with a bat fitted with the protective cover.

The protective cover sleeve for ball bats according to the present invention has a laminated composition. That construction includes a laminated sheet of flexible materials which has an outer lamination made of a stretchable fabric material, an inner lamination made of a fabric material, and a middle or core lamination located between the inner and outer laminations made of an elastomeric material. In embodiments fabricated and tested by the present inventor which performed satisfactorily, the outer lamination consisted of a sleeve of an abrasion resistant elastic fabric, such as a Spandex or Lycra containing polyester threads. The middle lamination consisted of a sheet of neoprene, and the inner lamination consisted of a sheet of a fabric such as nylon. The three laminations were bonded together to form a laminated fabric sheet.

An elongated rectangular piece of a three-layer lamination material of the type described above was formed into a longitudinally elongated tubular sleeve by folding confronting long edges of a rectangular sheet of the laminated material around a mandrel into a generally cylindrical shape. Opposed abutting longitudinal edges of the sheet were then fastened together by a sewn seam to form a tube. An outer transverse end of a first, front transverse end of the tubular sleeve was then formed around and adhered to a circular ring to shape the tube into a circular cross-section cylinder, and a fabric covered circular disk shaped end plate bonded to the forward transverse end of the tube.

In example embodiments of the protective cover which were fabricated and tested, a rear edge of the confronting longitudinal edges of the three-layer laminated sheet had oblique notches cut forward from the rear edges into the sheet to thus form a V-shaped notch when the longitudinal edges were fastened together. Hook-and-loop fabric fastener strips were then attached to opposed sides of the opening. The outer fabric lamination of these example embodiments of a protective cover for bats, was made of a "two-way" stretch blended polyester and Spandex fabric, in which the blended Spandex fabric was oriented in a direction that caused the circumferential stretchability of the tubular sleeve to be greater than its longitudinal stretchability.

Although basic embodiments of a hittable protective bat cover described above performed quite satisfactorily, it was discovered that quite small but visually perceptible markings were sometimes made to bats fitted with the cover. Formation of such markings was eliminated by adding an additional inner sleeve lamination made of a cotton fabric.

According to one aspect of the invention, a multi-function protective bat cover is provided which has a front weight pocket that is located at the front end of the tubular sleeve. The front weight pocket is preferably located inside the bore of the sleeve, rearward of the front end cap. The front weight pocket holds a weight member, preferably having a circular cross-section, disk-shape, which has a weight in the approximate range of from about 0.5 oz. to 8 oz., with a preferred range of from about 1 oz. to 4 oz.

According to another aspect of the invention, the multi-function protective cover also has one or more rear weight pockets located near the rear, open end of the cover sleeve. Since a rear pocket may be located in a region which is more likely to impact a ball, the rear pocket is optionally constructed to contain a substance such as sand or small metal beads which can flow under impact. In this embodiment, a rear pocket preferably has a readily openable and re-closable entrance opening, through which a selectable total weight of a flowable weight material such as sand, rubber granules, metal beads, or similar materials, may be inserted into or removed from the pocket.

According to another aspect of the invention, a multi-function protective cover for bats is provided with an optional inertial sensor. Inertial sensors including a multi-axes, gyroscopic accelerometer are widely available, and may be used to sense and output electrical signals which are proportional to the inclination, acceleration and velocity of a bat, in three coordinate directions of an inertial space.

In one embodiment of a multi-function hittable protective bat cover according to the present invention, an inertial sensor is held in a cushioned outer pocket located at the front end of the cover sleeve. Preferably, the inertial sensor includes an associated radio transmitter which transmits radio frequency signals proportional to measured bat motions via a Bluetooth or a similar RF protocol. Also, the inertial sensor may have an optional electronic memory device such as a flash memory chip to record sequences of measured values of accelerations and velocities of a sequence of bat swings. Recorded sequences can then be downloaded from the memory chip and played back after a batting session.

A multi-function protective bat cover according to the present invention may also optionally include an impact force sensor for measuring and transmitting signals which are proportional to impact forces of a bat striking a ball. The impact force sensor may consist of a tubular piezoresistive sensor which has the form of a thin cylindrically shell which fits coaxially inside or within the protective cover sleeve.

Electrical conductors in the form of traces on a flat, flexible printed circuit substrate extend longitudinally from the impact force sensor to a force sensor interface electronics module. The interface electronics module has circuitry for measuring variations of electrical resistance of the piezoresistive sensor in response to forces exerted on the sensor, and outputs electrical signals proportional to the forces. The measured force signals may be input to a Bluetooth transmitter and optional flash memory chip, preferably located in a small circular capsule-shaped module held in a cushioned outer pocket attachable to the front end of the protector sleeve.

One embodiment of the impact force sensing sensor includes a single, unsegmented tubular piezoresistive force sensor which outputs through a single pair of conductive traces a signal proportional to the force of a ball impacting at any location along the length of the sensor. Another embodiment uses a force sensor array that consists of a piezoresistive force and position sensor which is segmented into an array of longitudinally spaced-apart circular band-shaped sensor elements which are electrically isolated from each other. This embodiment outputs through a single common electrode trace and multiple separate conductive traces connected to individual sensor bands signals proportional to the magnitude of an impact force, and provides an indication of the longitudinal position on a bat where an impact has occurred.

BRIEF DESCRIPTION OF THE DRAWINGS

FIG. 1 is a perspective view of a Hittable Protective Cover For Ball Bats according to the present invention, showing a baseball bat of a type which the cover is intended to be used with.

FIG. 21 is an exploded view of a sixth, multi-function modification of a hittable protective cover for ball bats according to the present invention, which includes a tubular thin-film piezoresistive force impact magnitude and location sensor array that is segmented into longitudinally spaced-apart sensor zones.

FIG. 22 is a fragmentary perspective view of the force magnitude and location sensor array of FIG. 21.

DESCRIPTION OF THE PREFERRED EMBODIMENTS

Figure 1:
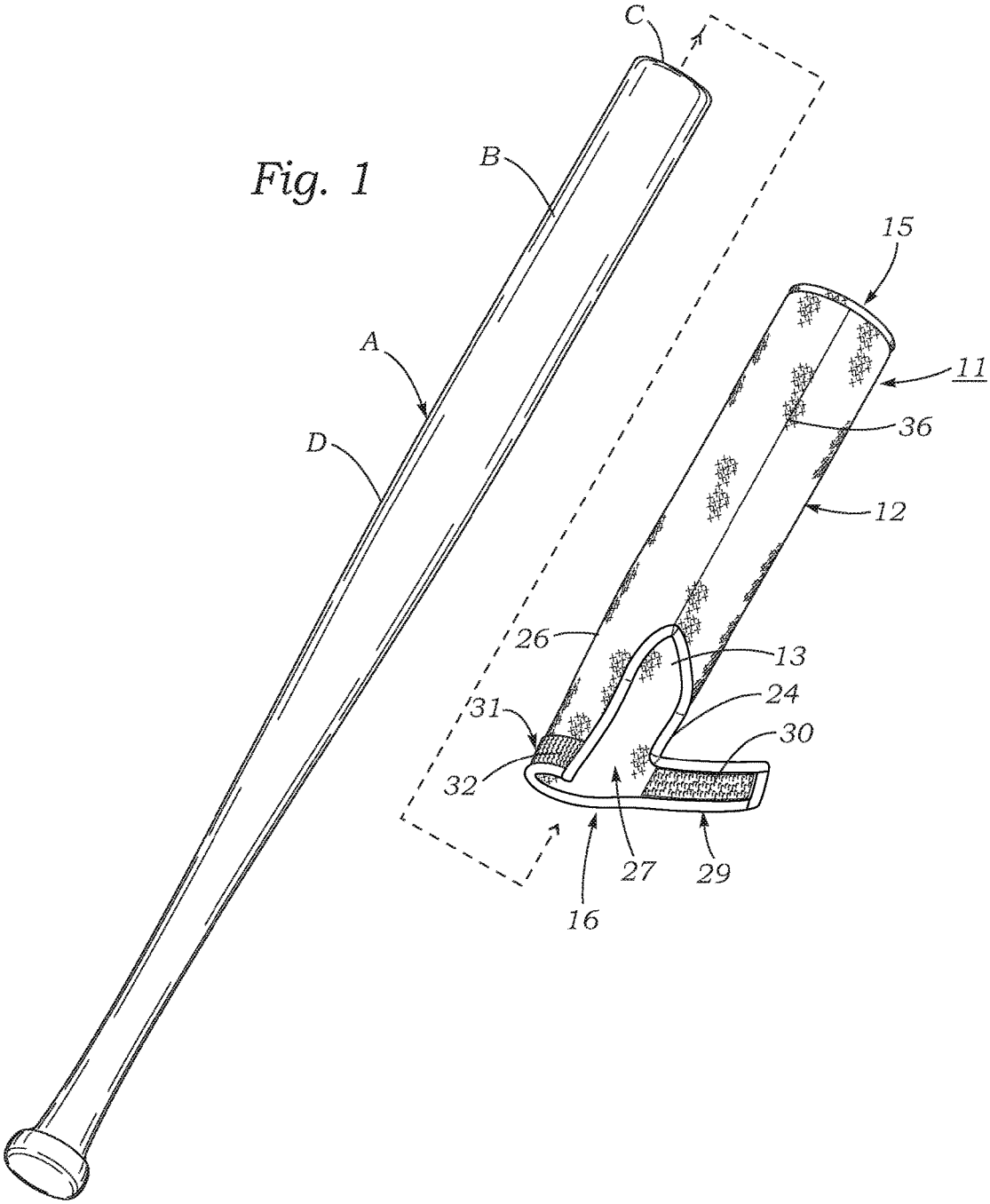

FIGS. 1-11 illustrate the construction and functions of a basic embodiment of a Hittable Protective Cover 11 For Ball Bats according to the present invention.

As shown in FIGS. 1-6, protective cover 11 includes a longitudinally elongated, generally cylindrically shaped sleeve 12. Sleeve 12 is preferably fabricated from a sheet of flexible laminated fabric material which has a composition that is described in detail below. As shown in FIGS. 1-5, sleeve 12 of protective bat cover 11 has extending through its length a longitudinally elongated, circular cross-section bore 13 of uniform diameter, and an outer cylindrical wall 14. Preferably, front transverse end of the sleeve 12 is sealed with a circular end cap 15, which forms the front transverse end of bore 13 through the sleeve.

Figure 9:
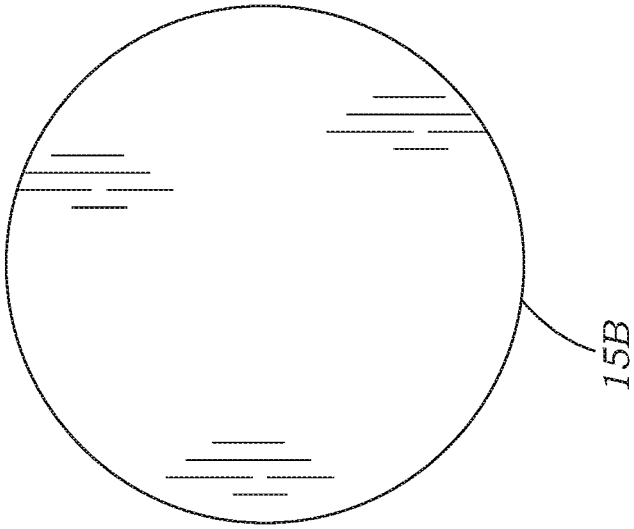
FIG. 9 is a top plan view of the stiffener disk of FIG. 8.
Figure 8:
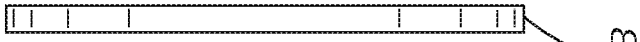
FIG. 8 is an edge view of a stiffener disk part of the protective cover of FIG. 7.
Figure 7:
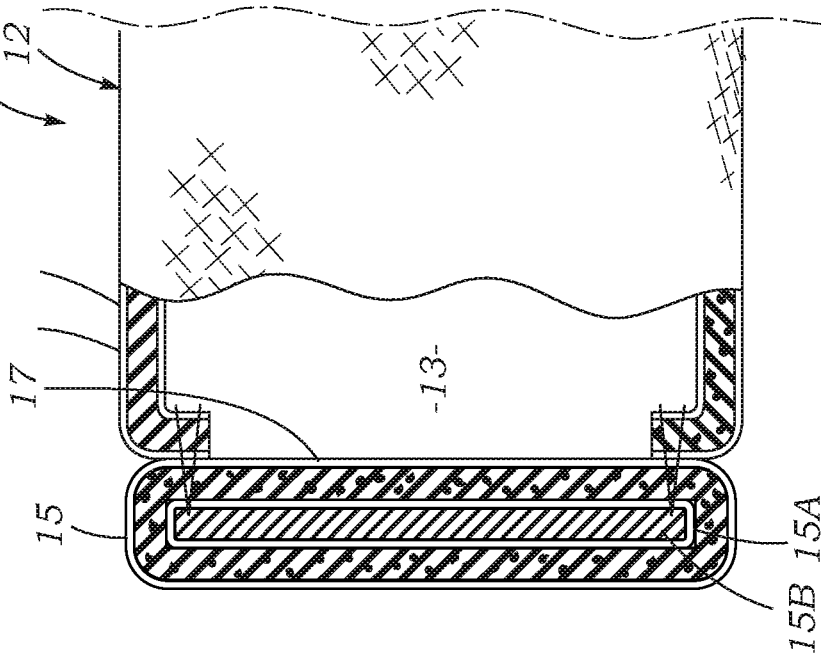
FIG. 7 is a longitudinal sectional view of the protective cover of FIG. 5, taken in the direction 7-7.

As is shown in FIGS. 7-9, the end cap may consist of a thin, circular cross-section wafer shaped pocket 15A which holds conformally therewithin a thin circular disk 15B which may be made of a resilient material such as rubber. Preferably, end cap 15 has a bright color which contrasts with the color of sleeve 12, such as orange or red for a sleeve colored black, slate or gray. Such a color contrast facilitates performing visual analyses of a batter's swings As may be seen best by referring to FIGS. 1, and 5, bore 13 through sleeve 12 has a rear opening 16. As may be understood by referring to FIGS. 1 and 2, opening 16 is provided to enable the front, larger diameter barrel end of a baseball bat or softball bat to be inserted into bore 13 of the sleeve. As may also be understood by referring to FIG. 1, sleeve 12 is constructed so that the front, barrel end B of bat A may be inserted through rear opening 16 of the sleeve into bore 13, and pushed forward until the front transverse end face C of the barrel abuts the inner transverse surface of front transverse end wall 17 of end cap 15 of the sleeve.

In embodiments of protective cover 11 which were tested by the present inventors, it was found that dimensions of sleeve 12 which were usable with bats of a variety of sizes and shapes included an overall length of about 16 inches, a bore diameter of about 2½ inches and a weight of about 2 ounces.

Figures 5, 6:
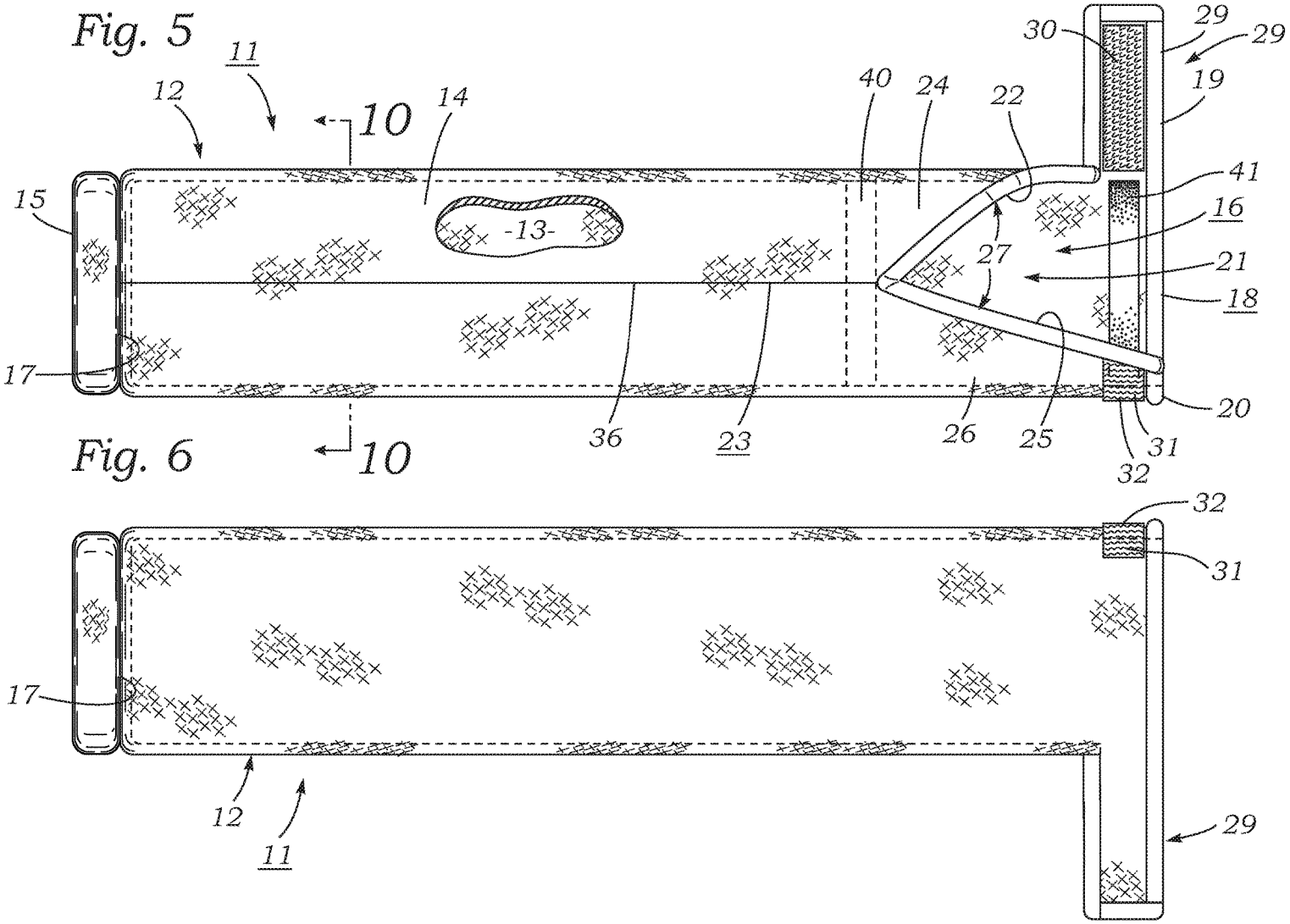
FIG. 5 is a top plan view of the protective cover of FIG. 1.
FIG. 6 is a bottom plan view of the protective cover of FIG. 1.

As may be seen best by referring to FIGS. 1 and 5, sleeve 12 has a transverse rear end wall 18 which has generally the shape of an annular ring which is segmented into two circumferentially spaced apart upper and lower sections 19 and 20 by a V-shaped notch 21. Notch 21 has an upper edge 22 which angles obliquely upwards from a longitudinal center line 23 of the notch to rear edge wall 18 to form an upper triangularly shaped flap 24. Similarly, notch 21 has a lower edge 25 which angles obliquely downwards from the longitudinal altitude line 23 to rear edge wall 18 to form a lower triangular flap 26. As shown in FIG. 5, notch 21 has in plan view the shape of a triangle that has a base which is parallel to transverse rear end wall 18 of sleeve 20, and an altitude 23 which lies on a longitudinal center line 23 on the outer cylindrical wall 19 of sleeve 14.

Partitioning of rear transverse end wall 18 of sleeve 12 by notch 21 into upper and lower flaps 24, 26 is provided to substantially enlarge the size of a rear entrance opening 27 to bore 13 of sleeve 12. As may be understood by referring to FIGS. 1 and 2, enlarged opening 27 facilitates insertion of the large barrel end of a ball bat into bore 13 of sleeve 12.

Sleeve 12 of protective cover 11 is also provided with a closure fastener 28 to cinch upper and lower flaps 24 and 26 together around the tapered part D of a bat which has been inserted into the sleeve.

As shown in FIGS. 3-6, closure fastener 28 includes fastener parts including a first, upper fastener part which consists of a rectangularly shaped strap 29 that extends radially outwards from upper edge 22 of upper flap 24. Fastener strap 29 has on a lower surface thereof a strip 30 of hook-type fabric fastener material.

Closure fastener 28 also includes a lower fastener part 31 which consists of a strip 32, of a loop-type fastener material on the upper surface of lower closure flap 26.

Figure 2:
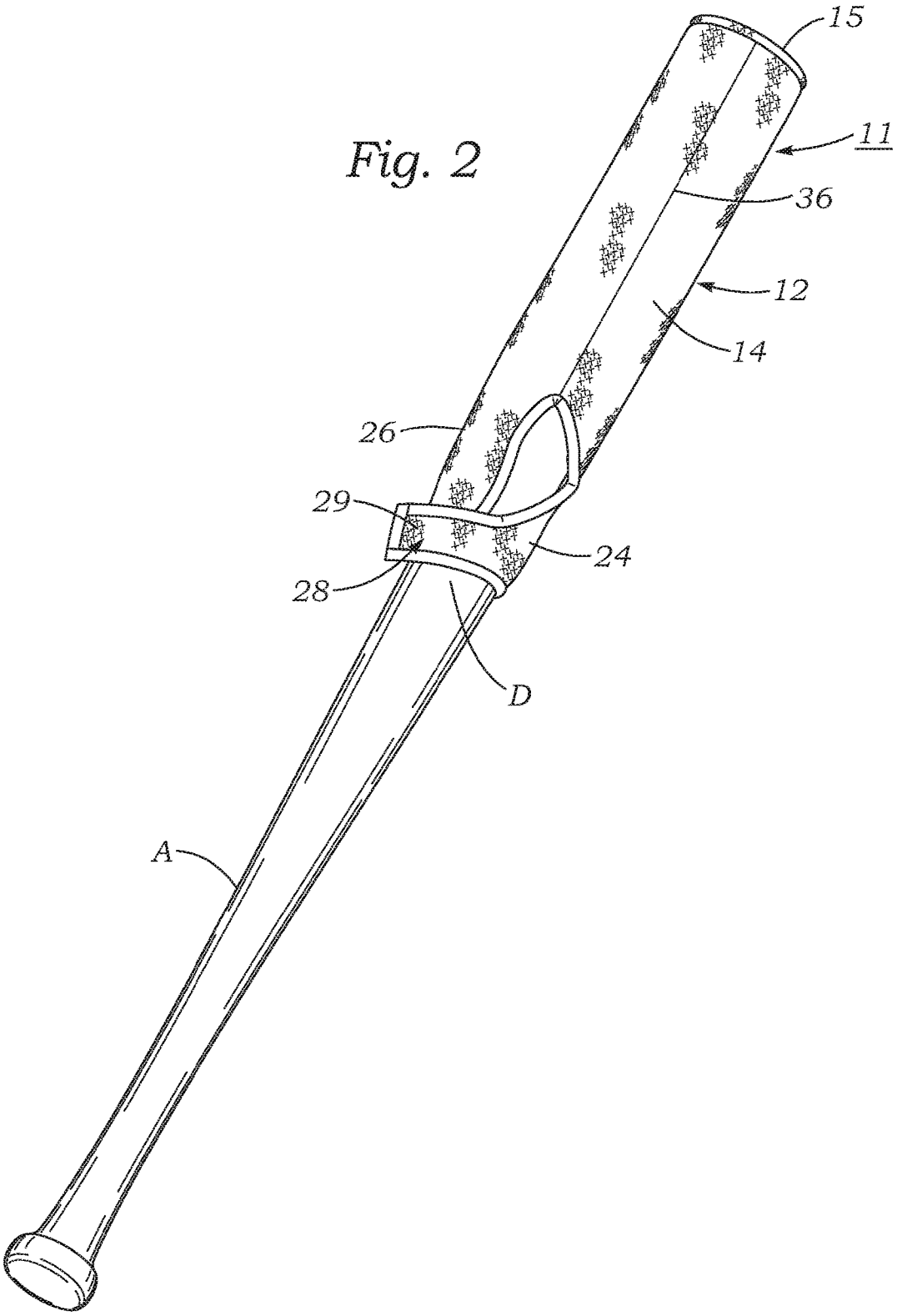
FIG. 2 is a perspective view of the cover according to the present invention, showing the protective cover removably attached to a baseball bat.
Figure 3:
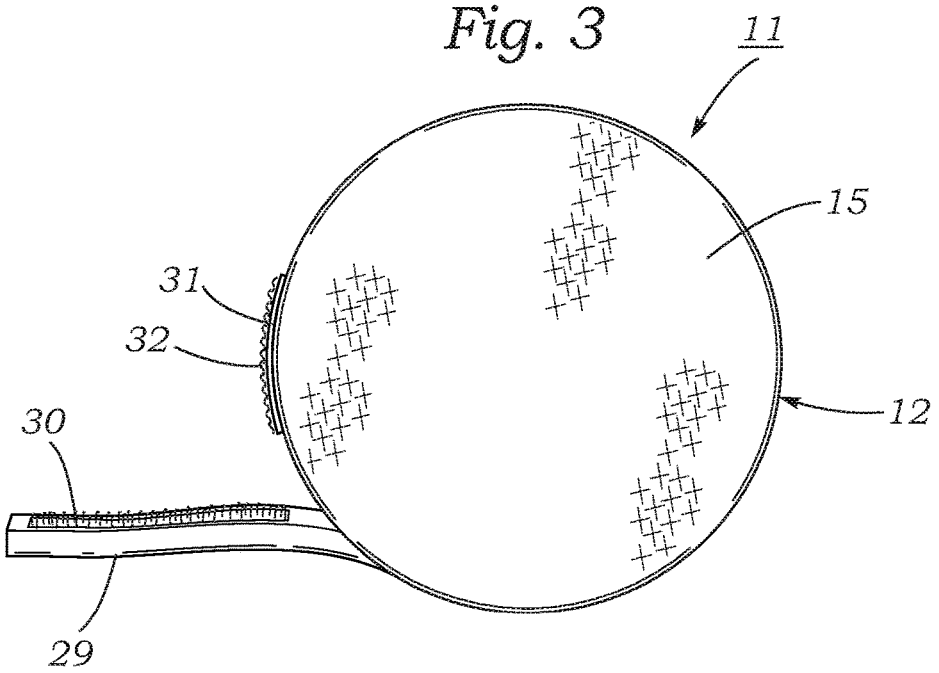
FIG. 3 is a front end elevation view of the cover of FIG. 1.
Figure 4:
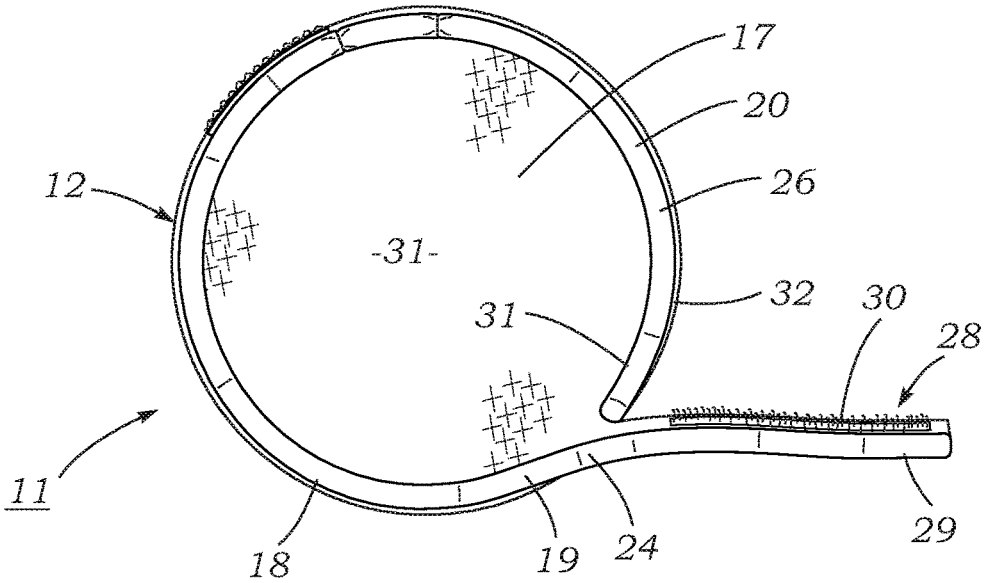
FIG. 4 is a rear end elevation view of the protective cover of FIG. 1.

As may be understood by referring to FIG. 2, sleeve 12 of protective cover 11 is secured to a bat A which has been fully inserted into the sleeve by folding upper fastener 29 of upper flap 24 downward to overlie lower fastener strip 32 on lower flap 26. Upper and lower fastener strips 29 and 31 are then pressed together to intermesh hooks of lower surface 30 of fastener strip 29 with loops of strip 32 to secure the two fastener parts together.

Figure 10:
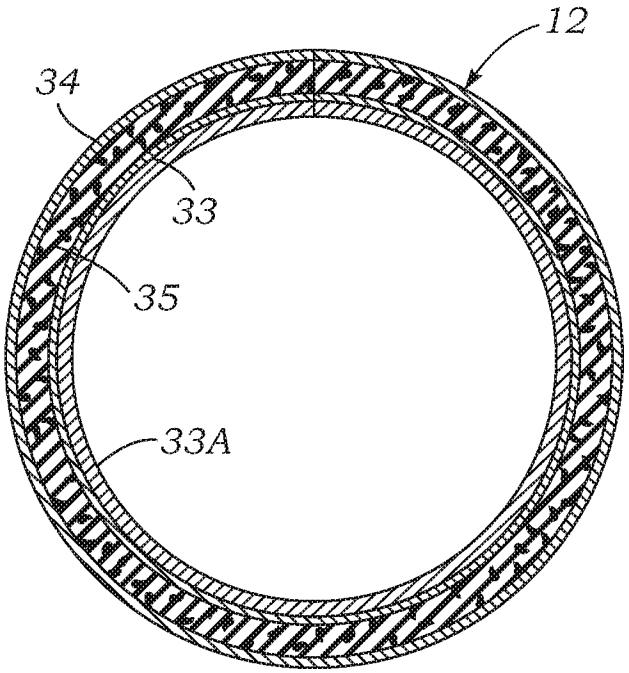
FIG. 10 is a transverse sectional view on an enlarged scale of the protective cover of FIG. 5, taken in the direction 10-10.
Figure 16:
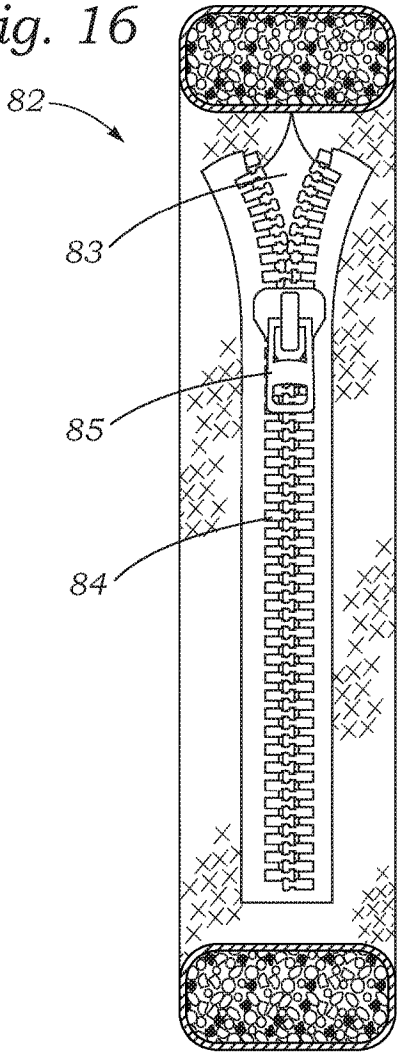
FIG. 16 is a fragmentary view of the modified cover of FIG. 13 on an enlarged scale, showing a rear weight pocket thereof.

The material composition of protective cover sleeve 12 which protects a bat against damage from impacts with a ball, while minimally affecting impact parameters and acoustic signature of a ball struck by a bat fitted with the protective cover, may be best understood by referring to FIGS. 7 and 10.

As shown in FIGS. 7 and 10, cover sleeve 12 is made of a flexible composite material which has a laminated construction. According to the invention the composition of sleeve 12 should provide elastic stretchability so that the sleeve may receive and elastically grip the outer circumferential surfaces of ball bats of various sizes when the front, barrel end of a bat is inserted into rear opening 16 of bore 13 of the sleeve and pushed forwardly in the bore until the front transverse end of the bat abuts the inner surface 17 of sleeve end cap 15.

Sleeve 12 was developed to have a capability for resiliently absorbing and distributing the impact energy of a ball struck by a bat fitted with protective cover 11, to thus prevent vigorous impacts with struck balls from denting or structurally damaging the barrel of a metal or wooden bat fitted with the protector. Also, sleeve 12 was designed with impact energy and shock absorbing properties which dissipate vibrations and sting forces that would otherwise be transmitted to the hands of a batter hitting a ball with a bat not fitted with the cover In addition to providing the foregoing properties, protective bat cover 11 was developed to provide a batting practice accessory which minimally affects impact parameters of a ball struck with a bat fitted with the protector, and which also has a minimal effect on the acoustic signature of sounds produced by the impact of the bat with a ball. Another desired characteristic of the material from which sleeve 12 was fabricated was a capability for assisting in retaining the sleeve in a fixed longitudinal position on a bat, in resistance to a tendency to slide forward due to linear momentum imparted to the sleeve during vigorous swings of a bat.

The present inventors have found that a material composition which largely satisfies the properties identified above consists of a novel laminated fabric. According to the invention, sleeve 12 has an inner lamination 33 made of a thin sheet of fabric material such as nylon or polyester, an outer lamination 34 made of an abrasion resistant, stretchable fabric such as Spandex blended with polyester threads, and an intermediate or core lamination 35 made of neoprene sandwiched between the inner and outer laminated sheets. An example lamination material which was found by the present inventors to fulfill the requirements of material properties for sleeve 12 as identified above was a material identified as AX or BAX Powertex and marketed by MACRO International Company, 78 Bunsen, Irvine, Calif. 92618. The AX or BAX Powertex material has an inner lamination 33 made of a woven fabric such as nylon or polyester The AX or BAX Powertex material also has an outer lamination 34 made of elastically stretchable Spandex blended with polyester threads. The intermediate, core lamination 35 is made of foam blended sponge sheet neoprene having a thickness in a range of about 0.5 mm to about 6 mm, with a preferred thickness range of about 1 mm to about 3 mm.

For the reasons described above, the AX or BAX Powertex material used to fabricate sleeve 12 was oriented so that the direction of greatest stretchability of the anisotropically stretchable ("two-way stretch") material was oriented perpendicularly to the longitudinal axis of sleeve 12. As may be understood by referring to FIGS. 5 and 6, sleeve 12 may be fabricated from a generally rectangularly shaped sheet of laminated material such as AX Powertex by folding the sheet around a cylindrically shaped mandrel and bonding together abutting long edges of the sheet by suitable means, such as a sewn seam 36.

In an alternate construction of sleeve 12 which performs satisfactorily, both outer lamination 34 and inner lamination 33 are made of a two-way stretchable, abrasion-resistant Spandex blended with polyester threads.

Both embodiments of a hittable protective bat cover described above performed satisfactorily. However, in testing those embodiments, it was discovered that certain bats fitted with the protective covers developed barely perceptible markings in the impact zones of the bats, after extensive and vigorous batting sessions. The present invention discovered that the formation of such markings was eliminated by adding to sleeve 12 a fourth, inner bat contact lamination consisting of a cotton sheet. Thus as shown in FIG. 10, sleeve 12 preferably includes a fourth, inner bat contact lamination layer 33*a* made of a woven cotton fabric, having a 10 oz/sq. yard weight, and a 1×1 rib pattern. The inner lamination liner 33 is bonded to the inner surface of inner lamination 33 by an adhesive bond.

Figure 11:
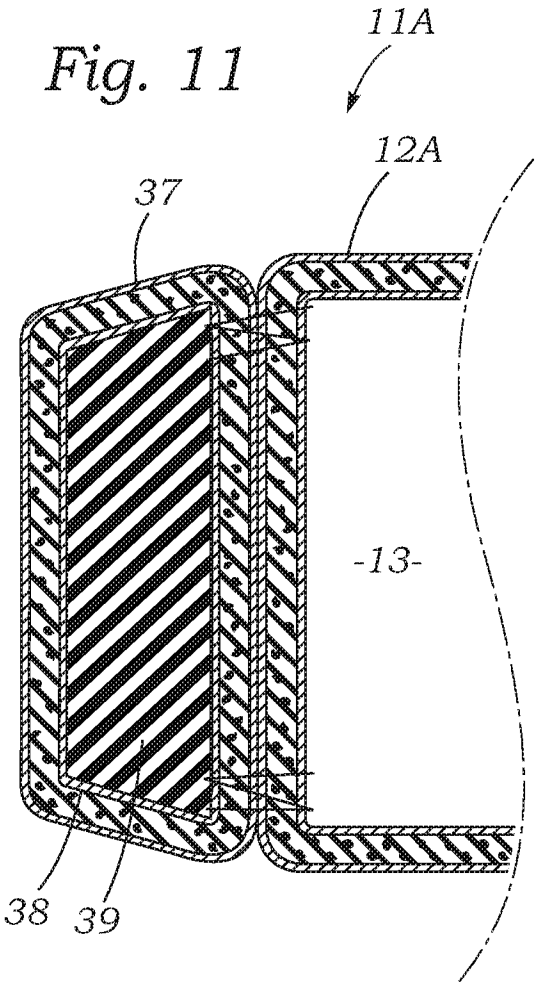
FIG. 11 is a fragmentary broken away view of a first modification of the protective cover of FIG. 1, which has an optional end-weight pocket.

FIG. 11 Illustrates a first modification 11A of bat protector 11. Modified bat protector 11A has a modified end cap cover 37 which has therewithin a frusto-conically shaped pocket 38 that holds conformally therewithin a frusto-conically shaped weight 39 having a weight in the approximate range of about 0.5 ounce to about 6 ounces, with a preferred weight of about 1 ounce to about 5 ounces. Weight 39 may be made of hard rubber or other suitable material. Optionally, end cap 37, pocket 38, and weight 39 may have cylindrical puck shapes as shown in FIG. 7.

As shown in FIGS. 5 and 6, sleeve 12 of protective cover 11 may optionally include one or more friction strips, such as friction strips 40, 41, which are made of a material such as a tacky elastomeric vinyl. The friction strips are fastened to the inner cylindrical wall surface 42 of sleeve 12, and are provided to further grip the surface of a bat and thus resist longitudinal sliding movement of the sleeve on a bat to which the sleeve is attached.

FIGS. 12-19 illustrate multi-function hittable protective bat covers which include additional modifications of a hittable protective cover for bats described above.

Figure 12:
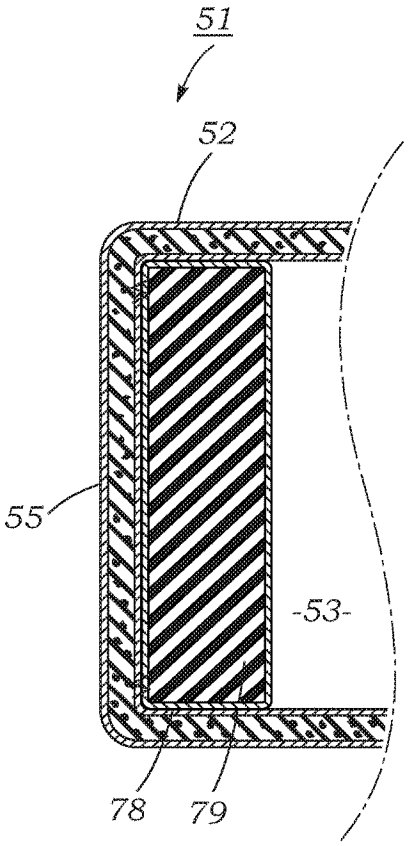
FIG. 12 is a partly broken-way view of a second, multi-function modification of a hittable protective cover for ball bats according to the present invention, which has an internally located front end weight.

Referring first to FIG. 12, it may be seen that a multi-function hittable protective bat cover 51 according to the present invention includes a protective sleeve 52 that has extending through its length a bore 53 which is closed at a front end thereof by a front transverse end wall 55. Multi-function cover 51 has located within bore 53 a short cylindrically shaped pocket 78 located adjacent to outer front end wall 55 of sleeve 52. Pocket 78 holds therewithin a weight member 79 which may have the form of a circular disk-shaped body having a weight selected to be in the approximate range of about 0.5 ounce to about 5 ounces.

Figure 13:
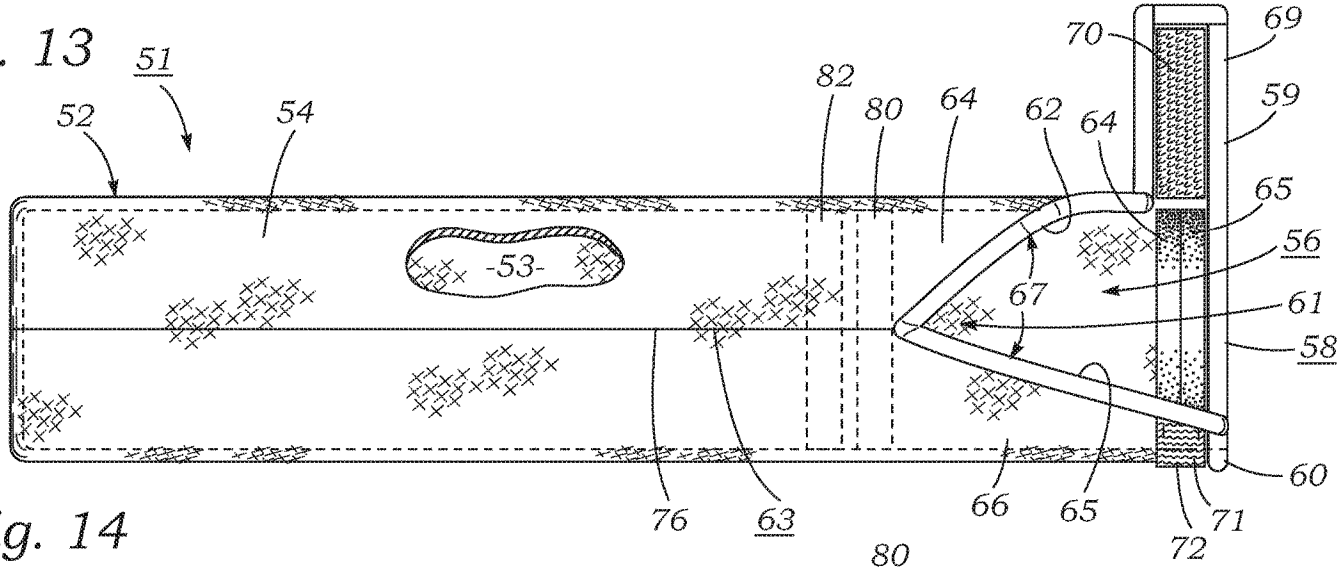
FIG. 13 is a partly broken-away top plan view of a third, multi-function modification of a hittable protective cover for ball bats according to the present invention, which has a rear weight pocket for rear weight materials.
Figure 14:
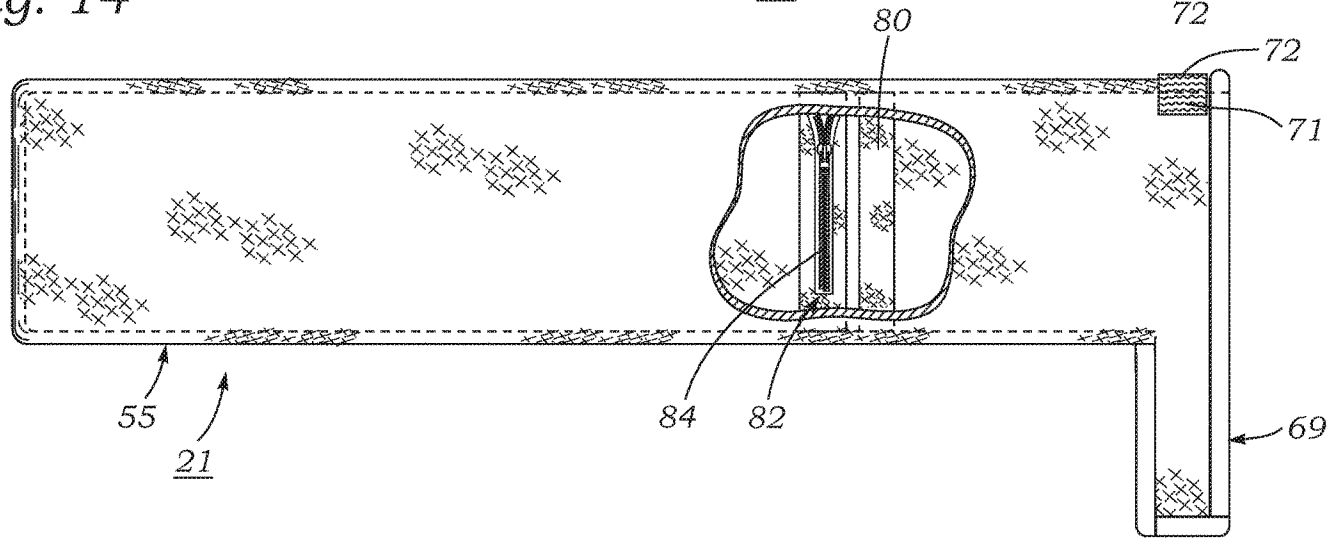
FIG. 14 is a partly broken-away bottom plan view of the modified cover of FIG. 13.
Figure 15:
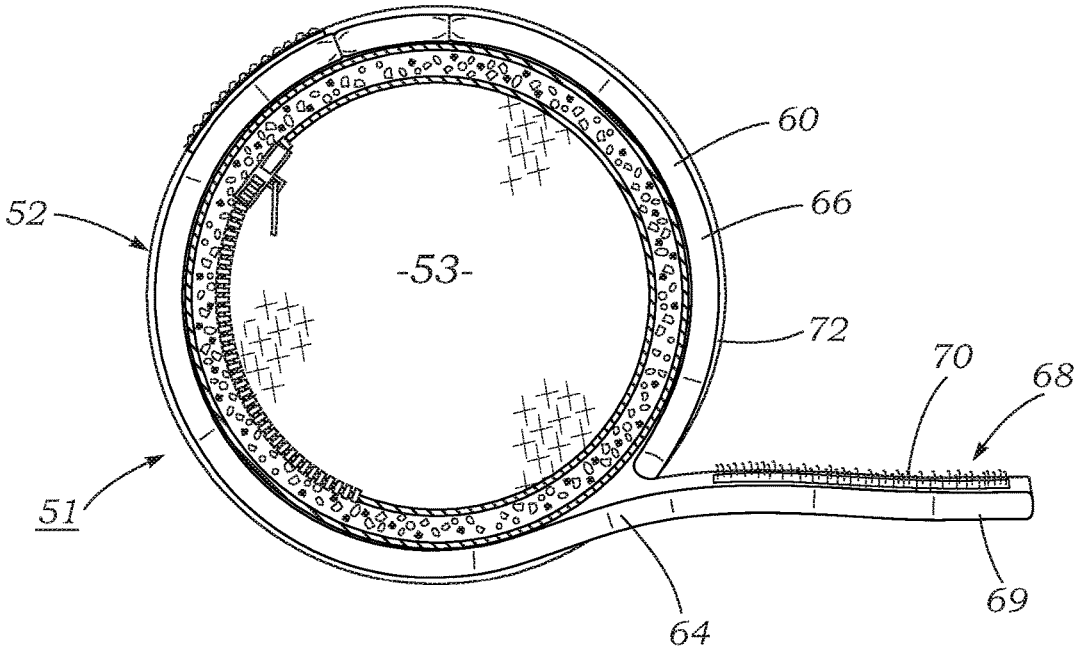
FIG. 15 is a transverse sectional view of the modified cover of FIG. 13.

As may be seen by referring to FIGS. 13-16, multi-function protective bat cover 51 may also include one or more additional weight pockets 80, 82 located near notch 61 which extends forward from rear transverse end wall 58 of sleeve 52. Thus as shown in FIGS. 13 and 14, multi-function protective bat cover 51 may have located within bore 53 of sleeve 52 a toroidal-shaped rear weight pocket 82 which is attached to the outer or preferably the inner cylindrical wall surface of sleeve 52. As shown in FIGS. 13 and 15, rear weight pocket 82 is located coaxially with respect to sleeve 52, and forward of rear opening 56 of the sleeve. As shown in FIGS. 13-16, rear weight pocket 82 has an opening 83 for receiving into the pocket a flowable weighting material such as sand, rubber granules, small metal beads, or similar materials. The opening 83 may consist of circumferentially disposed gap of a zipper 84 which is openable and closable by a zipper tab 85.

Multi-function protective bat cover 51 may also include a second, rear-end weight pocket (not shown) located closer to the rear transverse end wall 58 of sleeve 52, which may have a construction similar to rear weight pocket 72. Optionally, rear-end weights may consist of one or two bendable rubber strips 64, 65 fastened to the inner surfaces of sleeve 51, near rear opening 56 of the sleeve. Bendable rubber strips 64, 65 may optionally be enclosed in pockets fastened to the inner surface of sleeve 51. An example embodiment of sleeve 51 had a single rear strip 64 made of bendable neoprene rubber, which had a length of 3.125 inches, a thickness of 0.375 inch, durometer hardness of 40 durometer and a weight of about 1 oz. Optionally, multi-function protective cover 51 may also be provided with a front weight pocket similar to weight pocket 15 of protective cover 11 shown in FIG. 7. An example embodiment of sleeve 51 modified by the addition of front weight pocket included a weight having the shape of a circular disk made of EPDM having a diameter of 2 inches, a thickness of 0.375 inch, and a hardness of 0.40 durometer.

Figure 18:
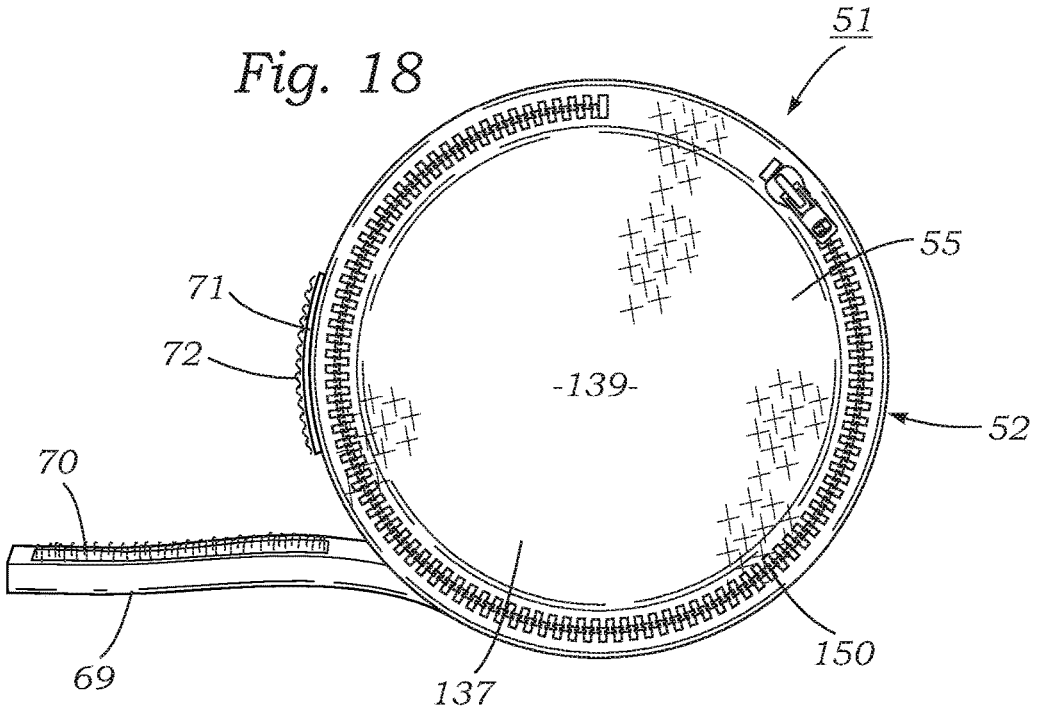
FIG. 18 is a front end elevation view of the protective cover of FIG. 16.
Figure 17A:
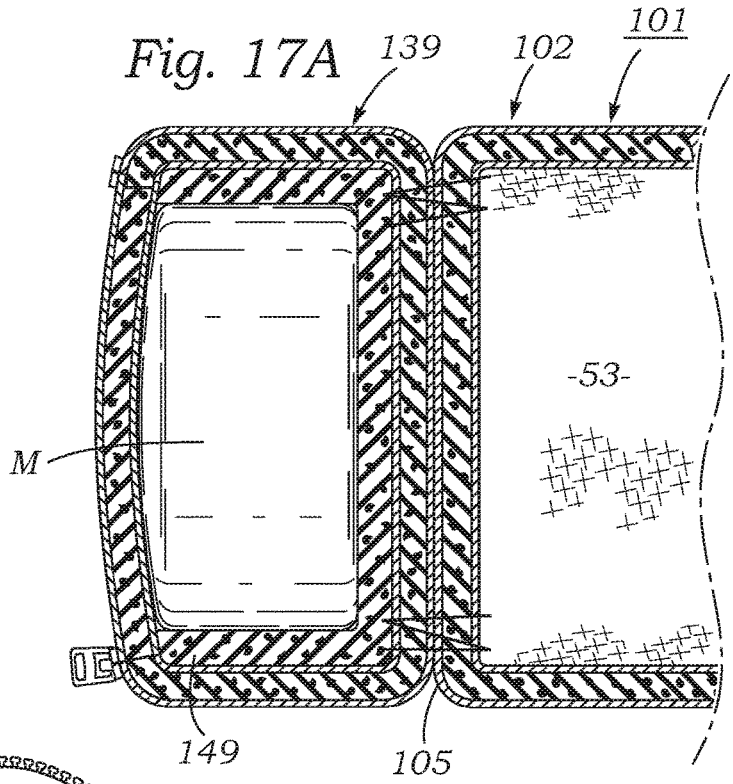
FIG. 17A is a partly broken-away view of a fourth, multi-function modification of a hittable protective cover for ball bats according to the present invention, which has a pocket for holding an inertial sensor device located in a front end cap of the protective cover.
Figure 17B:
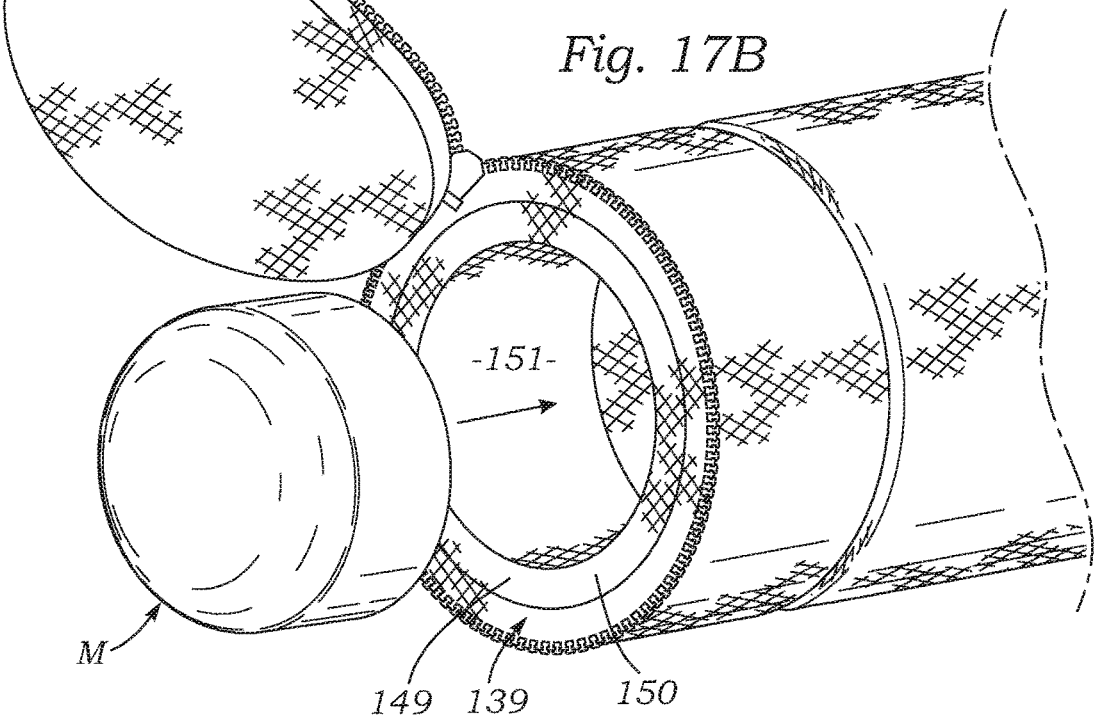
FIG. 17B is a fragmentary view of the protective cover of FIG. 17A, showing a cover flap of the pocket unzipped to allow access to the inertial sensor device.

FIGS. 17A, 17B, and 18 illustrate another modification of a hittable protective bat cover according to the present invention. As shown in FIGS. 17A and 18, modified protective cover 101 has attached to the front disk-shaped end wall 105 of a sleeve 102 a disk-shaped pocket 139. Pocket 139 has a disk-shaped interior space which is provided to hold therein a circular disk-shaped inertial sensor and telemetry module M which includes gyroscopic acceleration sensors, and a radio frequency transmitter that receives signals output from the sensors and transmits radio frequency signals which are indicative of inertial motions of a bat to which the module may be attached. Such sensor-telemetry modules are available from Zepp Corporation, 75 E. Santa Clara St., San Jose, Calif. 95113, and are identified as the Zepp 3A Swing Analyzer.

As shown in FIGS. 17A and 18, pocket 139 of protective cover 101 holds therein a cushioning sleeve 149 for supporting an inertial sensor-telemetry module M. Cushioning sleeve 149 has generally the shape of a cylindrical shell, and is preferably made of an elastomeric material such as foam rubber or an elastomeric polyurethane. As shown in the figures, cushioning sleeve 149 has extending into the front face 150 thereof a cavity 151 which has an appropriate size and shape to snugly receive therein a inertial sensor-telemetry module M.

As shown in FIG. 18, pocket 139 has a circular disk-shaped end cover flap 137. End cover flap 137 has a fastener such as a zipper fastener 150 which has the shape of a circular ring segment which is concentric with and spaced closely to the outer circumferential wall surface 151 of pocket 139. Unzipping fastener 150 enables flap 137 to be folded away from cavity 151 to allow access to module M for insertion and battery charging or replacement.

FIGS. 19-23 illustrate additional modifications of a multi-function protective bat cover according to the present invention. The modifications include a multi-function bat protector 161, shown in FIGS. 19 and 20, which includes an impact force sensor and telemetry transmitter for measuring and transmitting to a radio receiver such as a Bluetooth protocol receiver RF signals which are indicative of forces of a ball impacting a bat fitted with the cover. Multi-function bat protector 221, shown in FIGS. 21 and 22, includes an impact force magnitude and location sensor, and provides a capability for measuring and telemetering the longitudinal location of a ball impact on a bat in addition to the magnitude of the impact forces.

Figure 19:
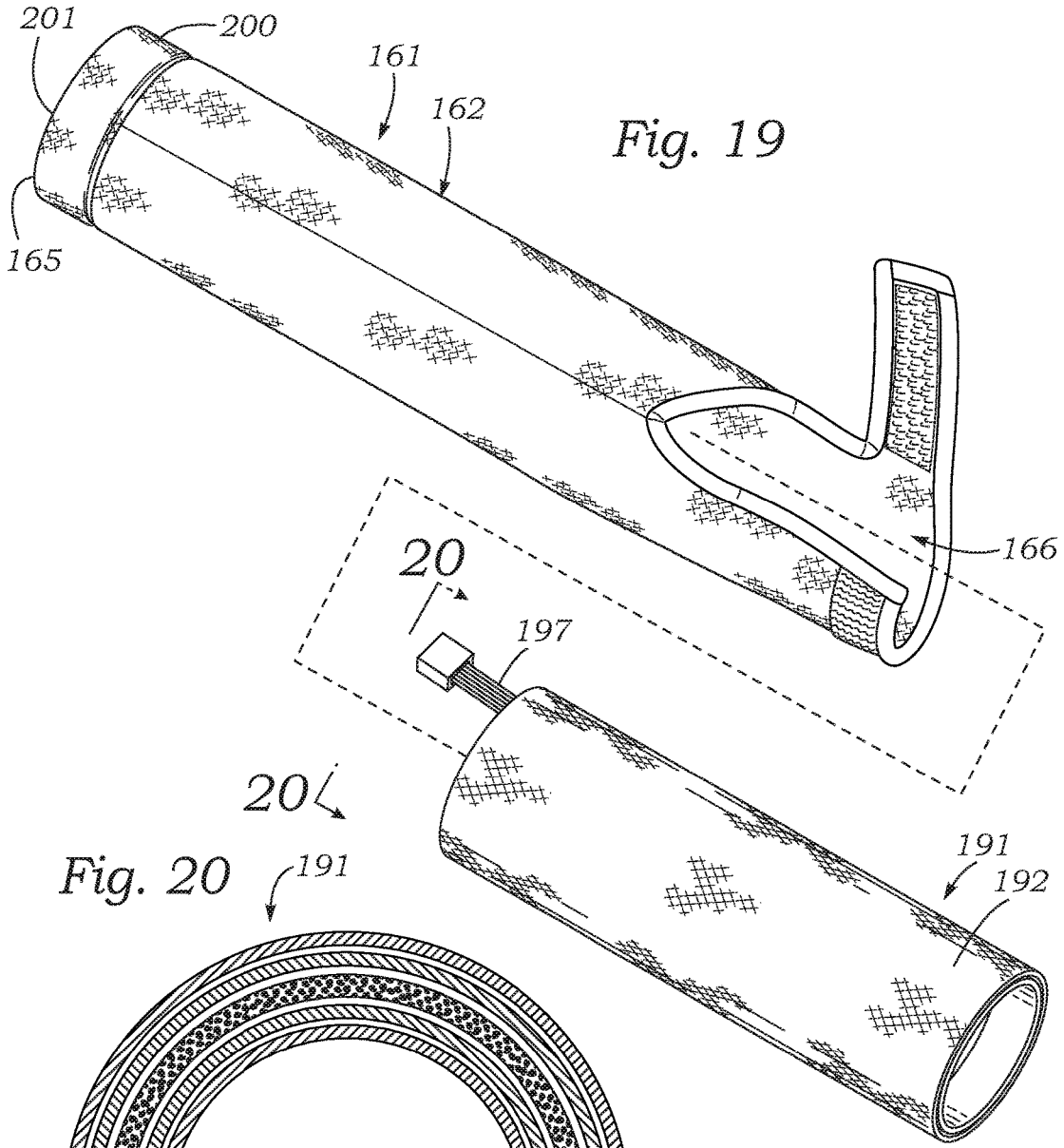
FIG. 19 is an exploded view of a fifth, multi-function modification of a hittable protective cover for ball bats according to the present invention, which includes a tubular thin-film piezoresistive impact force magnitude sensor.
Figure 20:
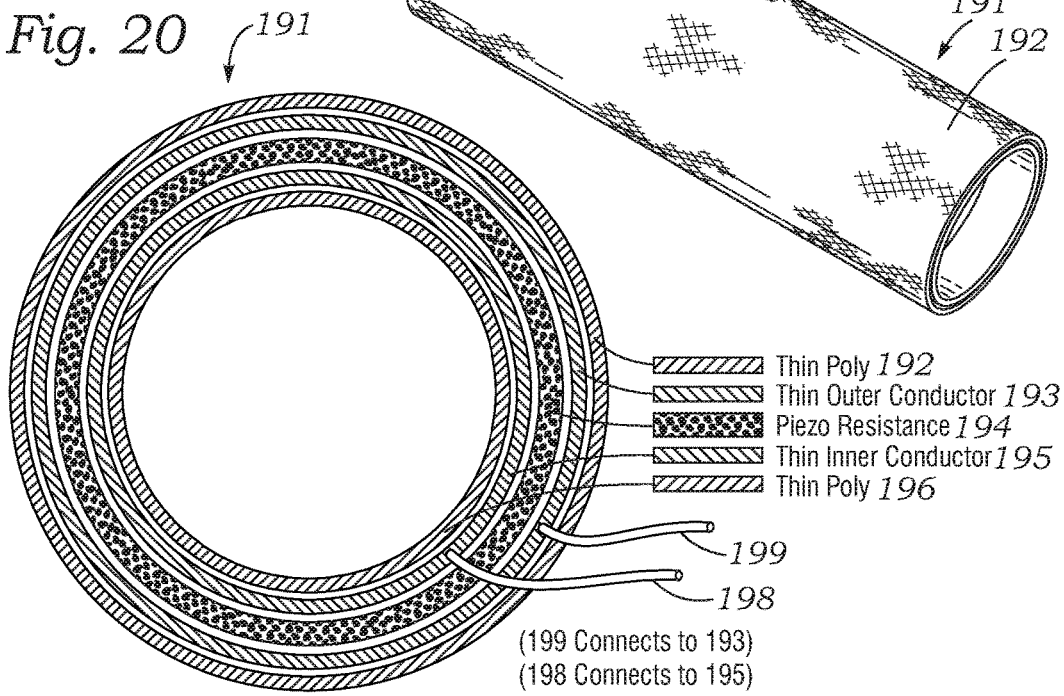
FIG. 20 is a transverse sectional view of the force magnitude sensor of FIG. 19.

Referring now to FIGS. 19 and 20, it may be seen that a basic embodiment of impact force sensing protective bat cover 161 according to the present invention includes an impact force sensor 191 that has generally the shape of a thin cylindrical shell. Sensor 191 has a diameter which enables it to fit coaxially within or optionally inside sleeve 162 of cover 161, and a length slightly less than the length of that part of bore 183 of sleeve 162 between front end wall 165 and the front vertex of V-shaped opening 166 at the rear end of the sleeve.

As may be understood by referring to FIGS. 19 and 20, impact force sensor 191 has a laminated construction which is comprised of coaxially arranged cylindrical shell-shaped laminations of equal length. The laminations are thin and flexible and include a thin outer insulating sheath or lamination 192 made of a flexible insulating material such as a polyethylene which covers an outer flexible electrically conductive lamination 193 that functions as a common ground potential electrode lamination. Impact force sensor 191 also has a middle piezoresistive lamination 194, an inner conductive lamination 195 made of a flexible electrically conductive sheet, and an inner insulating sheath 196 made of a thin polyethylene sheet. Details of the construction and functions of flexible piezoresistive sensors such as shown in FIGS. 19 and 20 are described in Taylor, U.S. Pat. No. 6,155,120, Piezoresistive Foot Pressure Measurement Method and Apparatus. The entire disclosure of U.S. Pat. No. 6,155,120 is incorporated by reference into the present disclosure.

As shown in FIG. 19, impact force sensor 191 has a thin, flat flexible insulating lead-out cable 197. Lead-out cable 197 may consist of a thin, flexible electrically insulating polymer substrate which has on its surface printed circuit conductors, including an outer electrical lead-out conductor 199 which is connected to outer flexible electrode lamination 193, and an innerflexible lead-out conductor 198 which is electrically conductively connected to inner flexible electrode lamination 195.

Figure 23:
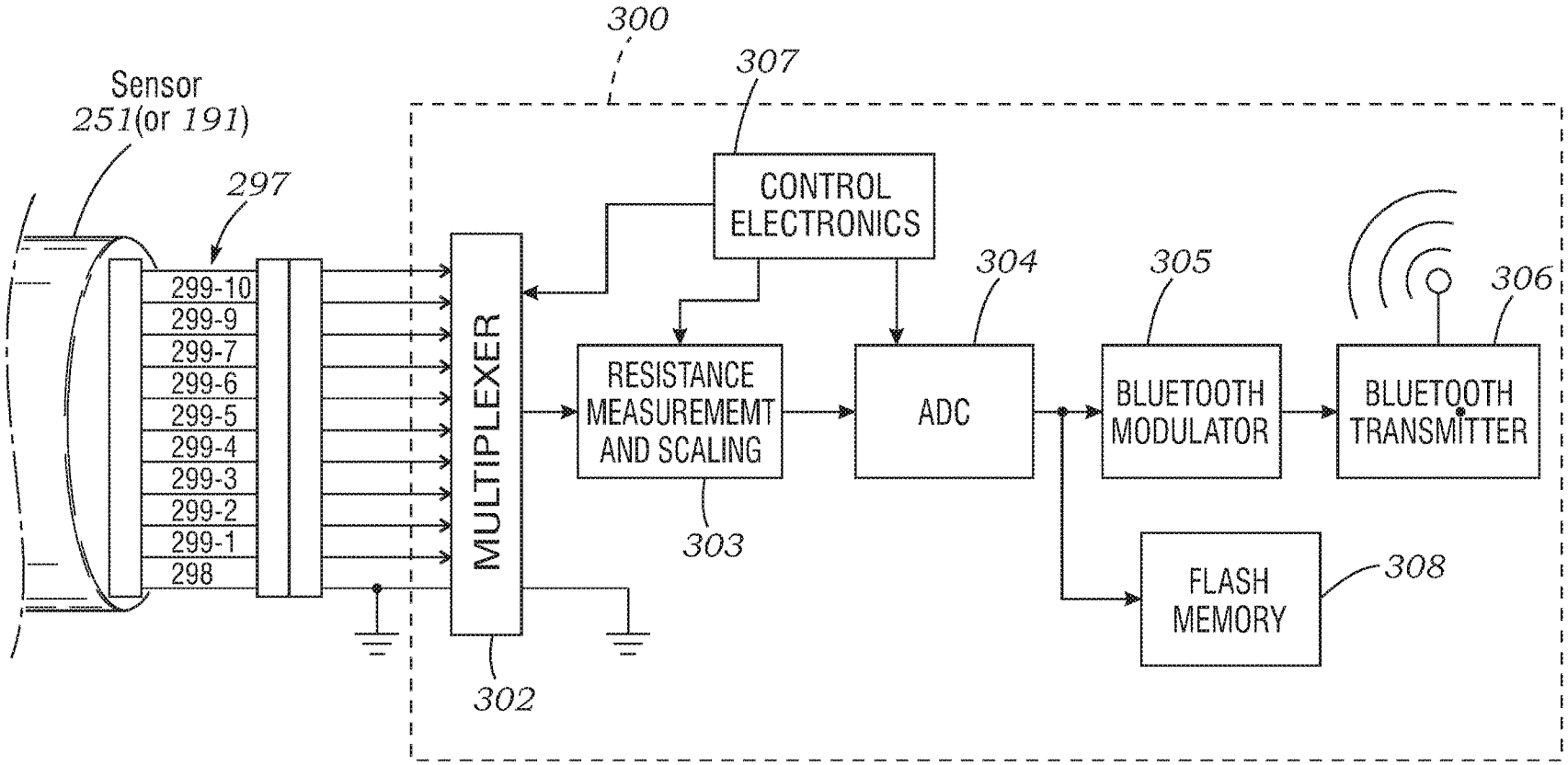
FIG. 23 is a simplified block diagram interface electronics of the protective covers of FIGS. 19-22.

As may be understood by referring to FIGS. 19, 20, and 23, lead-out conductors 198, 199 extend outwardly from the front edge of sensor 191 to an electronics interface module 300. Electronics interface module 300 is preferably mounted in a cushioned pocket 201 located at the front end of sleeve 162. Pocket 201 may have a construction similar to the pocket for the inertial sensor described above. Electronics module 300 contains circuitry for measuring the resistance between lead-out conductors 198, 199, which resistances are inversely proportional to impact forces exerted on the sensor by a ball hitting the outer surface of sleeve 162.

FIGS. 21 and 22 illustrate a modification 221 of multi-function hittable protective bat cover 161 shown in FIGS. 19 and 20 and described above. Multi-function bat protector 221 has a force impact sensor array 251 which is a modification of force sensor 191. Modified force sensor array 251 provides a capability for determining the longitudinal location of impact of a ball on a bat, in addition to an indication of the magnitude of the impact force.

As shown in FIG. 21, impact force magnitude and location sensor 251 comprises an array of individual sensor elements. In this array, the inner flexible conductive electrode lamination 195, of force magnitude sensor 191, which may have the form of a continuous cylindrical shell, is replaced by an inner electrode lamination 255, which has a different topology. Thus as shown in FIGS. 21 and 22, inner electrode lamination 255 of sensor 251 has a shape which is similar to that of a thin electrical conductive cylindrical shell made of a thin, flexible electrically conductive material such as electrically conductive fabric, similar to inner electrode shell 195 of sensor 191. However, cylindrical electrode shell 255 of sensor 251 is segmented into a longitudinally arranged series of flat, circular electrically conductive bands 255-1 through **255-*n*. The electrically conductive bands are spaced closely together, and electrically isolated from each other by narrow, non-conductive strips 256-1 through 256-*n*. As shown in FIG. 22, separate electrically-conductive, inner lead-out conductor 299-1 through 299-*n* are connected to individual sensor bands 255-1 through 255-*n*. Sensor 251 also includes an outer, common ground potential lead-out conductor 298 which connects to an outer common flexible sleeve electrode 293. Lead-out conductors 255-1 through 255-*n* are contained in a cable 297**.

In the above-described construction of impact force magnitude and location sensor 231, variations in electrical resistances of sensor element bands 255-1 through **255-*n* in response to a ball striking the outer surface of sleeve 162 of bat protector 161 will depend upon the longitudinal impact zone of the ball, as well as the magnitude of impact forces. Thus, for example, sensor 231 may have ten sensor bands 255-1 through 255-10, sensor band 255-1 being located adjacent to the rear end of sleeve 162, and sensor band 255-10 being adjacent to the front end of the sleeve. With this arrangement, a ball impacting sleeve 162 near its rear end causes a momentary decrease in electrical resistance of one or more lower number sensor element bands, e.g., 255-1 and 255-2. By continuously measuring the electrical resistance of all ten sensor element bands 255-1 through 255-*n***, or cyclically measuring the resistance of each element at a rate much faster than the recovery time for each piezoresistive sensor element, both the magnitude of a ball impact force on a bat, and the longitudinal zone of the bat where the ball impact occurred may be accurately determined.

FIG. 23 is a simplified block diagram of interface electronics 300 for impact force sensor 191 or impact force magnitude and location sensor 251.

As shown in FIG. 23, interface electronics 300 includes a multiplexer 302 for cyclically connecting to a selected sensor element, to a resistive measurement circuit 303 for measuring the resistive of an element and scaling the measured resistance value to an output signal proportional to impact force.

Interface electronics 300 includes an analog to digital converter (ADC) 304 which converts measured analog force values to digital signals, and a digital modulator module 305 which inputs digital force magnitude values and location signals to a Bluetooth-type radio frequency transmitter 306. Interface electronics 300 also includes a control logic module 307 which issues signals for controlling functions of each other module of the interface electronics, including the location of the centroid of a ball impact on sensor array 251. Interface electronics 300 may also contain a flash memory chip 308 for storing sequences of measured values of ball impact force magnitudes and longitudinal locations of the impacts.

What is claimed is:

1. A protective cover for ball bats comprising a tubular sleeve having extending through its length a bore for insertably receiving a bat, said sleeve having extending forward from a rear transverse edge thereof a notch which divides a rear length of said sleeve into a radially spaced-apart first and second flap sections having therebetween an enlarged opening larger than the bore diameter of said sleeve, and a closure fastener for cinching said first and second flap sections into compressive contact with a bat inserted forward through said opening into said bore of said sleeve, the cover wherein said sleeve is made at least partially of an elastically stretchable material, and wherein said sleeve has a laminated construction including a first, outer abrasion resistant elastically stretchable material, a second, intermediate lamination made of an elastomeric material, and a third, inner lamination made of an elastically stretchable material.

2. The cover of claim 1 wherein said sleeve includes a fourth lamination bonded to the inner surface of said inner lamination, said fourth lamination being made of fabric sheet.

3. The cover of claim 2 wherein said fabric is cotton.

* * * * *